US006406200B2

(12) United States Patent
Mahoney

(10) Patent No.: US 6,406,200 B2
(45) **Date of Patent: *Jun. 18, 2002**

(54) PRINTER ASSEMBLY WITH LATERAL AND LONGITUDINAL SELF-ALIGNMENT

(75) Inventor: Steven A. Mahoney, McMinnville, OR (US)

(73) Assignee: Inovise Medical, Inc., Newberg, OR (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/364,712

(22) Filed: Jul. 30, 1999

(51) Int. Cl.[7] ..... B41J 2/315

(52) U.S. Cl. ..... 400/120.16; 400/120.17; 400/690.4; 400/693; 347/222

(58) Field of Search ..... 400/120.16, 120.17, 400/693, 692, 691, 690.4, 175, 120.01, 139, 174, 679, 689, 690; 347/222

(56) References Cited

U.S. PATENT DOCUMENTS

| | | | | |
|---|---|---|---|---|
| 4,383,772 A | | 5/1983 | Meier et al. | 400/55 |
| 4,560,292 A | * | 12/1985 | Takahashi | 400/59 |
| 4,641,980 A | | 2/1987 | Matsumoto et al. | 400/120 |
| 4,663,638 A | | 5/1987 | Hirose | 346/136 |
| 4,674,899 A | | 6/1987 | Kimura | 400/605 |
| 4,896,166 A | | 1/1990 | Barker et al. | 346/76 |
| 5,030,968 A | | 7/1991 | Benson et al. | 346/76 |
| 5,172,137 A | | 12/1992 | Hongo et al. | 346/76 |
| 5,181,787 A | | 1/1993 | Hosomi | 400/120 |
| 5,198,836 A | | 3/1993 | Saito et al. | 346/76 |
| 5,431,503 A | | 7/1995 | Aizawa et al. | 400/642 |
| RE35,026 E | | 8/1995 | Mahoney | 400/120.17 |
| 5,599,113 A | | 2/1997 | Suzuki et al. | 400/120.16 |
| 5,631,690 A | | 5/1997 | Tashiro et al. | 347/220 |
| 5,779,371 A | | 7/1998 | Aoyama et al. | 400/120.6 |
| 5,791,796 A | | 8/1998 | Gustavsson et al. | 400/693 |
| 5,876,129 A | * | 3/1999 | Suzuki | 400/120.01 |
| 5,980,138 A | * | 11/1999 | Shiozaki et al. | 400/582 |

* cited by examiner

*Primary Examiner*—Andrew H. Hirshfeld
*Assistant Examiner*—Minh H. Chau
(74) *Attorney, Agent, or Firm*—Birdwell Janke & Durando, PLC

(57) ABSTRACT

A printer assembly with lateral and longitudinal self-alignment. The printer assembly has a frame, a door which swings open, a motor-driven platen disposed on the door, a print head movably disposed on the frame so as to engage the platen, and a spring coupled to the print head so as to produce both backward force to urge the print head against the platen when the door is closed and torque to rotate the print head upwardly when the door is opened. The frame is provided with a semi-cylindrical paper well and a generally triangular shape for ease of access to the paper well.

16 Claims, 2 Drawing Sheets

PRINTER ASSEMBLY WITH LATERAL AND LONGITUDINAL SELF-ALIGNMENT

BACKGROUND OF THE INVENTION

This invention relates to printers. More specifically, it relates to printer assemblies that employ linear arrays of symbol generation elements by which the recording medium is passed, particularly thermal printers having heating elements arranged in a linear array on a print head which creates characters or other symbols on thermal printer paper as it passes by the print head.

Thermal printers are well known and widely used for many applications, particularly where high printing speed or small physical space are required. For example, a thermal printer may be particularly suitable for incorporation in a portable medical patient monitoring instrument, where the principle function of the instrument is to measure accurately, display and record physiological waveforms and parameters, as well as trend information about the patient's vital signs. Thermal printers lend themselves to high printing speeds which are needed to print waveforms, such as an electrocardiogram, in real time so as to be immediately available to clinicians.

At the same time, image quality is always a concern with a printer to ensure that the information recorded thereby can easily and accurately be read. In essentially any printer where, as in a thermal printer, a two dimensional image is created by moving the printing paper between a platen and a linear array of printing elements disposed on an elongate print head forced against the paper, it is important that the force applied by the print head to the paper be substantially uniform throughout the length of the paper. Meeting this requirement can be a challenge because of the need also to provide a mechanism for loading paper into the printer so that it passes between the print head and the platen.

A thermal printer assembly that is particularly effective in providing such uniform force while permitting paper to be loaded therein is disclosed in Mahoney U.S. Pat. No. Re. 35,026 entitled SELF-ALIGNING THERMAL PRINT HEAD AND PAPER LOADING MECHANISM, hereby incorporated by reference in its entirety. The printer assembly of this Mahoney patent employs a lateral self-alignment mechanism which urges the print head against the platen to provide uniform lateral distribution force. However, this assembly does have some important limitations. First, it employs a sliding door for opening the printer to load paper, which requires space behind the printer to open the door. Second, it requires the use of flat, folded printer paper which takes more space and often is not as easy to use as a cylindrical roll of printer paper. Third, the paper can be difficult to install because it must be placed into a deep paper well, partially under the sliding cover. Fourth, because the motor for driving the platen is mounted on the frame of the printer and the platen itself is mounted on the cover, the cover must be carefully aligned with the frame so that a gear on the frame will engage a gear on the cover to operate the platen.

Another approach is to use a cylindrical roll of paper and a cover that is hinged so as to swing, rather than slide, open. A printer assembly which uses this approach is shown, for example, by Gustavsson et al. U.S. Pat. No. 5,791,796, entitled THERMAL PRINTER WITH SPRING-BIASED DRIVE ROLLER/PLATEN. In addition, the Gustavsson et al. printer employs a platen drive motor mounted on the door, which avoids the problem of aligning the door with the frame so as to ensure that gears properly mesh. However, the Gustavsson et al. device does not provide for lateral self-alignment of the print head with the platen so as to apply uniform force against the platen.

Although it would be desirable to employ a cylindrical roll of paper and a door that is hinged so as to swing, rather than slide, open, the application of uniform force is important to achieve good print quality. The problem is that a lateral self-alignment mechanism of the type shown in Mahoney, which has a sliding door, will not readily work with a swinging door of the type shown in Gustavsson et al., at least without undue complexity, because the platen and the print head will interfere with one another when the door is opened and closed.

Accordingly, there is a need for a printer assembly that provides the advantages of lateral self-alignment of a print head with a platen and the advantages of a door that swings open and closed so as to provide better utilization of space, ease of use and high print quality.

SUMMARY OF THE INVENTION

The present invention meets the aforementioned need by providing a printer assembly with both lateral and longitudinal self-alignment. The printer assembly has a frame, a top door hinged at the back of the frame to swing open, a motor-driven platen disposed at the front, underside of the door, a print head disposed at the front of the frame, and a spring coupled to the print head so as to produce both backward force to urge the print head against the platen when the door is closed and torque to rotate the print head upwardly when the door is opened. The print head is disposed on a mounting assembly which has a centrally located tab that provides a fulcrum and engages a spring. The spring provides both backward force and torque to rotate the print head upwardly when the door is open.

The platen is driven by a motor which is also mounted on the door and connected by a gear train to the platen so as to transmit rotational motion to the platen. The frame is provided with a semi-cylindrical well for receiving a cylindrical roll of printer paper, and has a generally triangular shape for easy access to the well when the door is open.

Therefore, it is a principal object of the present invention to provide a novel and improved printer assembly with both lateral and longitudinal self-alignment.

The foregoing and other objects, features and advantages of the present invention will be more readily understood upon consideration of the following detailed description of the invention, taken in conjunction with the following drawings.

DETAILED DESCRIPTION OF THE INVENTION

Figure 1:
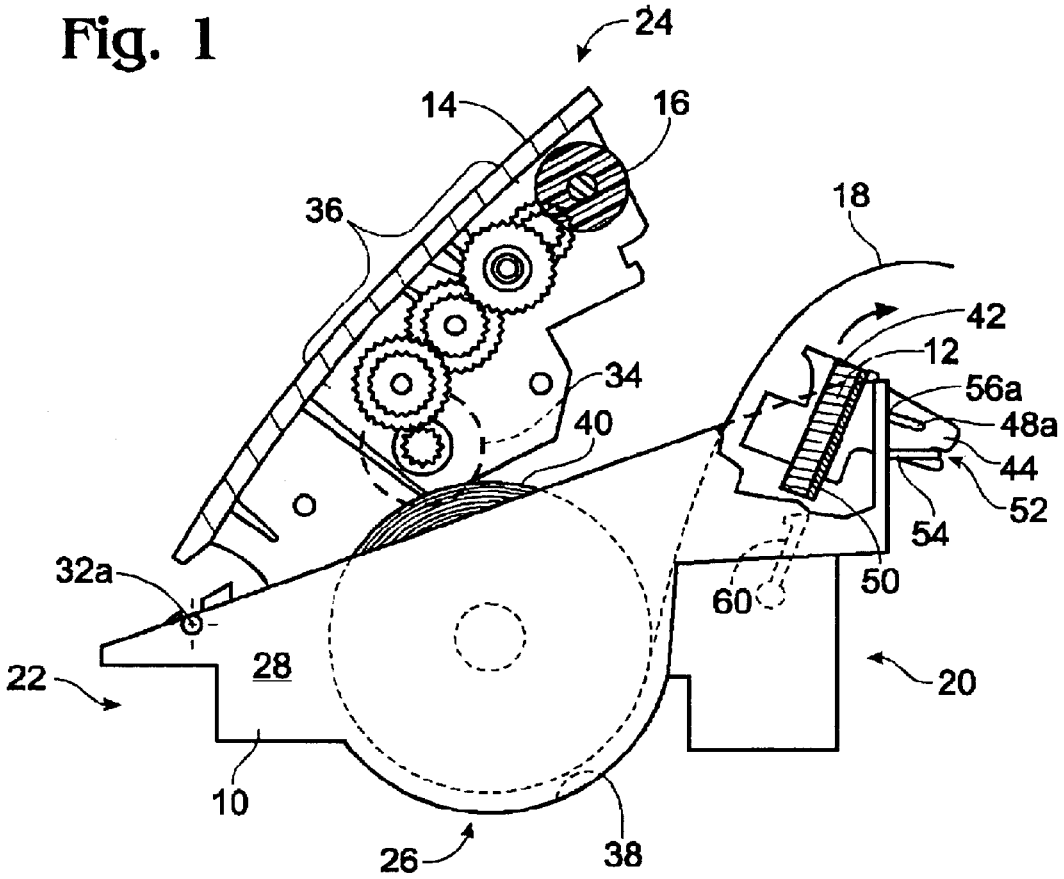
FIG. 1 is a side elevation of a preferred embodiment of a printer assembly according to the present invention, with the door thereof shown in an open position and in partial cross-section.
Figure 2:
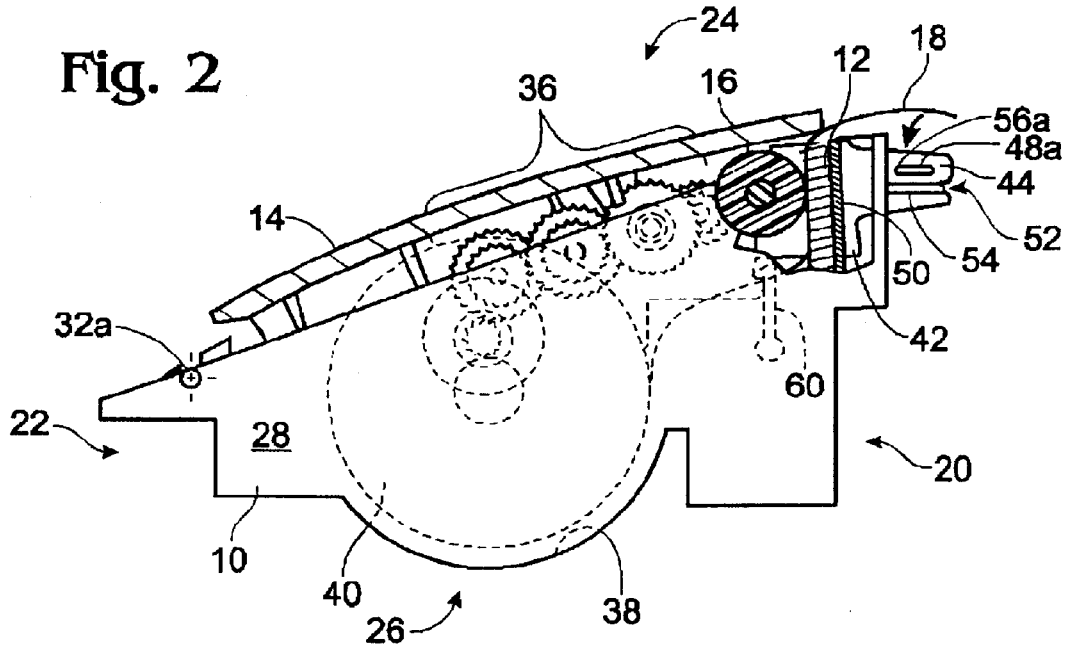
FIG. 2 is a side elevation of a the preferred embodiment of the printer assembly according to the present invention, with the door thereof shown in a closed position and in partial cross-section.

Referring first to FIGS. 1 and 2, the printer assembly generally comprises a frame 10, a print head 12, a hinged door 14, and a motor-driven platen 16 mounted on the door 14 for engaging the print head 12 with paper 18 disposed therebetween when the door 14 is closed. For purposes of reference, the printer assembly and frame have a front 20, a back 22, a top 24, a bottom 26, and two sides 28 and 30 (see FIGS. 3 and 4), respectively. The dimension from side-to-side of the printer assembly is referred to herein as the lateral dimension, and the dimension from top-to-bottom is referred to herein as the longitudinal dimension.

Figure 3:
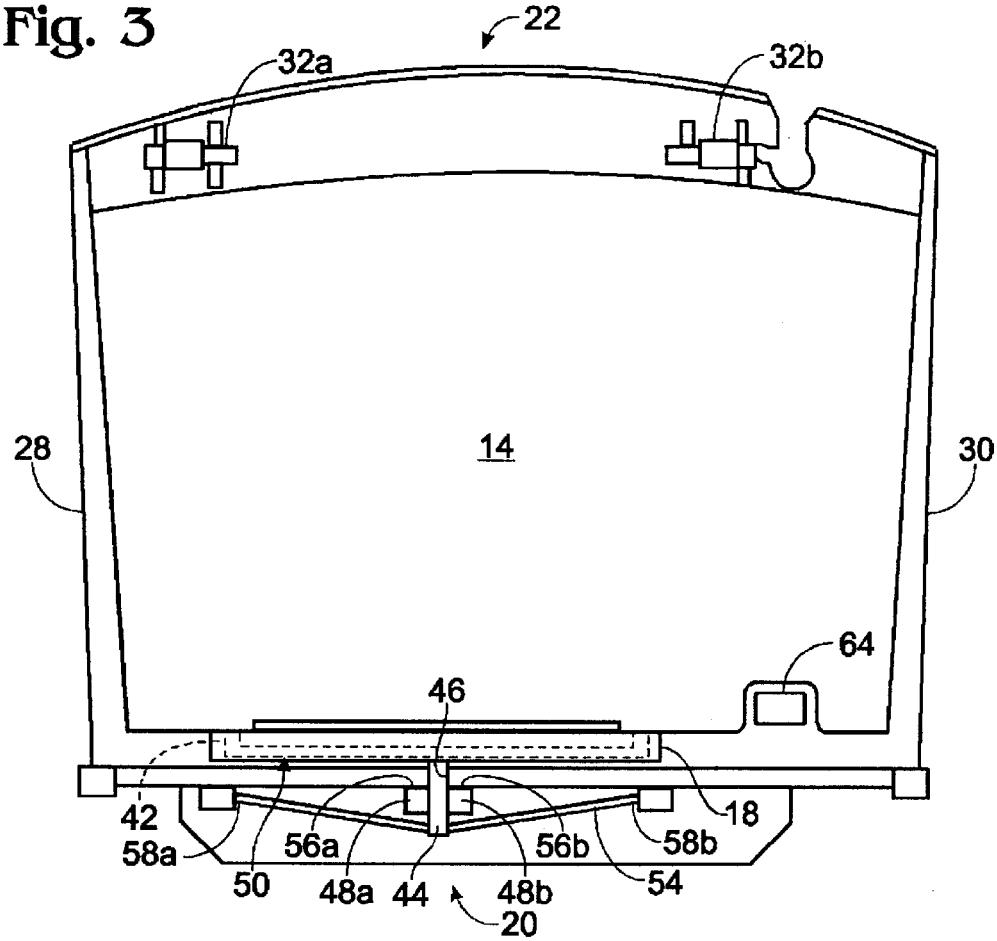
FIG. 3 is a top view of a the preferred embodiment of the printer assembly according to the present invention.
Figure 4:
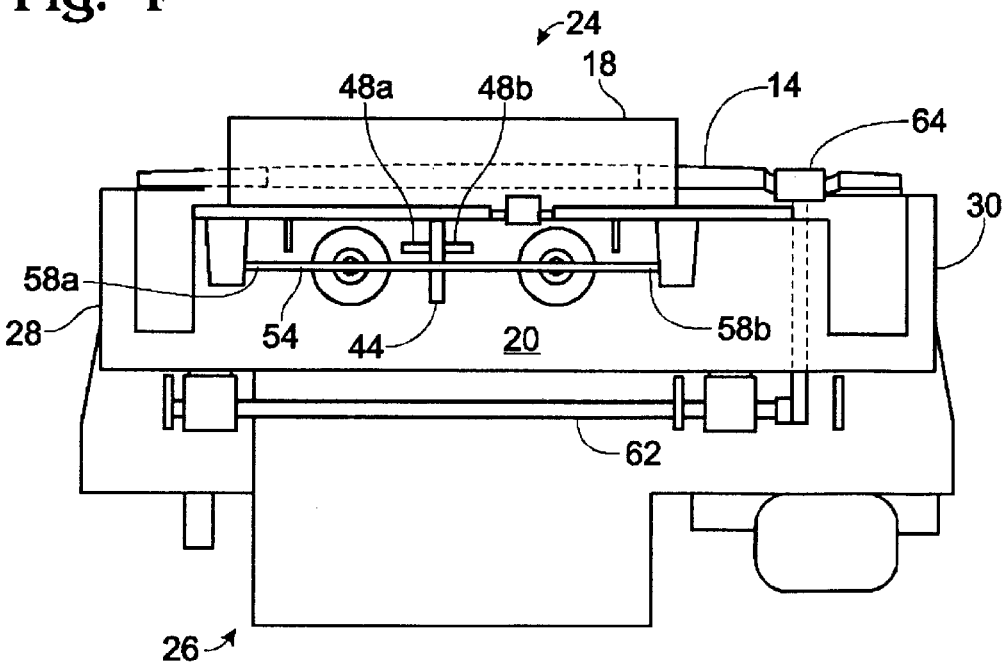
FIG. 4 is a front elevation of a preferred embodiment of the printer assembly according to the present invention.

The door 14 is attached to the frame at or proximate the back thereof by two hinges 32*a* and 32*b*, as shown in FIG. 3. The type of hinge mechanism is not critical to the invention, and other hinge mechanisms not inconsistent with the object of the invention may be used without departing from the principles of the invention. The hinges enable the door 14 to be pivoted to an open position, as shown in FIG. 1, or to a closed position, as shown in FIGS. 2–4. The platen 16 is rotatably mounted at or proximate the front, underside of the door 14 and driven by a motor 34, also mounted on the door. The motor transmits rotational motion to the platen through a gear train 36 mounted on the door. The operation of the motor and gear train to drive a platen in a printer of this type is commonly understood in the art.

The door 14 is provided with a pair of latches 60 to hold it closed. The latches are interconnected by a shaft 62 to a push button 64 which, when actuated, rotates the shaft and releases the latches so the door can open.

The frame 10 includes a semi-cylindrical well 38 for receiving a roll of printer paper 40. The preferred embodiment of the invention contemplates use of a thermal print head and heat-sensitive printer paper to create an image. Such paper is commonly available in cylindrical rolls as shown in FIGS. 1 and 2. However, where uniformly distributed force applied by the print head to the platen is important, other types of print heads and print paper might be used without departing from the principles of this invention. Preferably, the frame is generally triangular shaped, as viewed from the side, so as to facilitate easy access to the paper well.

The print head 12 is pivotally mounted to the frame at the front 20 thereof so that, when the door 14 is opened, the print head will rotate upwardly along the longitudinal dimension to disengage with the platen 16 and, when the door 14 is closed, the print head will rotate downwardly along the longitudinal dimension as the platen engages the print head. These two positions can be particularly seen in FIGS. 1 and 2. The print head also is mounted so as to float in the lateral dimension when the door 14 is closed and the platen 16 engages the print head. Thus, the printer assembly provides both longitudinal and latitudinal self-alignment when the door is closed with paper 18 disposed between the platen and the print head.

The print head 12 is supported by a mounting assembly 42. The mounting assembly includes a frontwardly-directed tab 44 which is disposed substantially centrally of the mounting assembly in the lateral dimension. The tab fits through a slot 46 in the front of the frame. The tab includes a pair of wings 48*a* and 48*b* extending laterally thereof but set back from the front surface 50 of the mounting assembly 42 so as to be disposed on the front side of the front 20 of the frame. The tab 44 also includes a slot 52 for receiving a spring 54. The spring 54 urges the tab toward the back of the frame, the back edges 56*a* and 56*b* of the wings 48*a* and 48*b*, respectively, limiting the backward distance that the mounting assembly 42 can travel. Preferably, the spring 54 is an elongate wire spring having a circular cross-section and is retained at its ends 58*a* and 58*b* to the frame 10. This permits the tab 44 to rotate about the spring 54 in the slot 52. The ends 58*a* and 58*b* of the spring are attached to the frame 10 backwardly from the slot 52 so that the spring is under tension and thereby applies force against the inner wall of the slot 52. This both urges the print head 12 backwardly toward the platen 16, while allowing the print head to pivot laterally about the point of contact of the spring 54 and slot 52 so as to provide lateral self alignment, and produces rotational torque to provide longitudinal self alignment, as described hereafter.

The slot 52 is offset downwardly in the longitudinal dimension from the wings 56*a* and 56*b*. When the door 14 is closed, the platen 16 pushes frontwardly on the print head so that the back edges 56*a* and 56*b* of the wings 48*a* and 48*b*, respectively, are pushed slightly away from the front surface of the frame 10. Thus, the print head mounting assembly 42, and print head, float in the lateral dimension. When the latches 60 are released so that the door 14 can open, the mounting assembly 42 and print head will rotate in the longitudinal dimension around the spring 54 in the slot 52. This permits the platen 16 to disengage the print head; indeed, as the door 14 is opened and the platen begins to swing upwardly and backwardly, the tabs 56*a* and 56*b* will be forced against the front of the frame 20 and act as a fulcrum so that the spring in the offset slot 52 provides rotational torque to force the platen upwardly, thereby opening the door. Once the door is open, the spring 54 keeps the print head in an upwardly rotated position so as to receive the platen when the door is closed.

It is to be appreciated that, while a particular preferred type of spring and tab assembly have been shown, other spring and tab assemblies might be employed to provide both backward force and rotational torque such that the print head self-adjusts laterally and longitudinally, without departing from the principles of the invention.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

I claim:

1. A printer assembly, comprising:

a frame, having a front, a back, a top, and two opposing sides;

a top door attached at one end thereof to said frame proximate the back of said frame so as to swing open and closed;

a cylindrical platen rotatably attached to and disposed proximate the opposing end of said door so that its elongate dimension runs from side to side of said door;

an elongate print head disposed proximate the front of said frame so that its elongate dimension runs substantially from side to side of said frame; and a spring disposed proximate the front of said frame, and coupled to said frame and said print head so as to urge said print head backwardly, said print head having a centrally disposed element that engages said spring, so that said print head rotates upwardly and downwardly about said spring to disengage and engage said platen when said door is opened and closed, respectively.

2. The printer assembly of claim 1, wherein said print head is disposed within said frame and said centrally disposed element of said print head comprises a forwardly extending, upwardly oriented tab disposed through a slot in said frame, said tab having lateral fulcrum elements disposed in front of said frame for pivotally engaging said frame, said spring engaging said tab below said fulcrum elements.

3. The printer assembly of claim 2, wherein said spring comprises an elongate resilient member attached at opposing ends to said frame and having, at the position of engagement with said tab, a curved surface for permitting said tab to rotate upwardly and downwardly.

4. The printer assembly of claim 3, wherein said spring comprises a wire having a substantially circular cross section.

5. The printer assembly of claim 1, wherein said spring comprises an elongate resilient member attached at opposing ends to said frame and having, at theposition of engagement with said centrally disposed element, a curved surface for permitting said centrally disposed element to rotate upwardly and downwardly.

6. The printer assembly of claim 5, wherein said spring comprises a wire having a substantially circular cross section.

7. The printer assembly of claim 1, further comprising a motor for driving said platen, said motor being mounted on said door and engaging said platen.

8. The printer assembly of claim 7, wherein said motor is disposed to one side of said door.

9. The printer assembly of claim 8, further comprising a gear train mounted on said door and connected between said motor and said platen for transmitting rotational motion to said platen.

10. The printer assembly of claim 1, wherein said frame has a bottom, said printer assembly further comprising a paper well disposed at the bottom of said frame for receiving paper so that the paper can be fed upwardly between said platen and said print head.

11. The printer assembly of claim 10, wherein said paper well is semi-cylindrical in shape so as to receive a roll of paper.

12. The printer assembly of claim 10, wherein said frame is lower in back than in front so as to facilitate access to said paper well.

13. A method for aligning a printer assembly, comprising the steps of:

providing a frame including a front, back, a top and a bottom, an elongate print head movably attached to the frame at the front thereof, a door pivotally attached at one end thereof to the frame at the back thereof, and a cylindrical platen rotatably attached to the door at an opposing end thereof, the elongate axis of the platen being substantially parallel to the elongate axis of the print head, so as to disengage and engage the print head and platen when the door is open and closed, respectively, while providing substantially uniform force applied by the print head against the platen throughout the length of the print head when the door is closed;

applying lateral force to said print head substantially at the lateral center thereof so as to urge said print head backwardly against said platen when said door is closed;

applying torque to said print head so as to rotate said print head in the direction of rotation opposite the direction of rotation of said door when said door is opened so as to disengage said platen from said print head; and rotation said print head in the direction of rotation opposite the direction of rotation of said door when said door is closed by engaging said platen with said print head.

14. The method of claim 13, wherein said lateral force and said torque are applied by the same means.

15. A method for aligning a printer assembly, comprising the steps of:

providing a frame including a front, a back, a top and a bottom, an elongate print head movably attached to the frame at the front thereof, an opening at the top of said frame for receiving printer paper, a door pivotally attached at one end thereof to the frame at the back thereof so as to cover said opening, and a cylindrical platen rotatably attached to the door at an opposing end thereof, the elongate axis of the platen being substantially parallel to the elongate axis of the print head, so as to disengage and engage the print head and platen when the door is opened and closed, respectively, while providing substantially uniform force applied by the print head against the platen throughout the length of the print head when the door is closed;

applying lateral force to said print head substantially at the lateral center thereof so as to urge said print head backwardly against said platen when said door is closed; applying torque to said print head so as to rotate said print head in a direction opposite to the direction of rotation of said door when said door is opened so as to disengage said platen from said print head; and rotating said print head opposite to the direction of rotation of said door when said door is closed by engaging said platen with said print head.

16. The method of claim 15, wherein said lateral force and said torque are applied by the same means.

* * * * *